US005771679A

United States Patent [19]

Taylor, Jr. et al.

[11] Patent Number: 5,771,679

[45] **Date of Patent: *Jun. 30, 1998**

[54] ALUMINIZED PLATEAU-BURNING SOLID PROPELLANT FORMULATIONS AND METHODS FOR THEIR USE

[75] Inventors: Robert H. Taylor, Jr., Harvest, Ala.; Carol J. Hinshaw, Ogden, Utah

[73] Assignee: Thiokol Corporation, Ogden, Utah

[ * ] Notice: The term of this patent shall not extend beyond the expiration date of Pat. No. 5,579,634.

[21] Appl. No.: 760,727

[22] Filed: Dec. 5, 1996

Related U.S. Application Data

[63] Continuation of Ser. No. 220,100, Mar. 30, 1994, abandoned, which is a continuation-in-part of Ser. No. 981,774, Nov. 25, 1992, Pat. No. 5,334,270, which is a continuation-in-part of Ser. No. 827,207, Jan. 29, 1992, abandoned.

[51] Int. Cl.[6] ..... C06B 45/10

[52] U.S. Cl. ..... 60/219; 149/19.4; 149/19.9; 149/19.92; 149/19.1

[58] Field of Search ..... 149/19.9, 19.4, 149/19.92, 19.1; 60/205, 219

[56] References Cited

U.S. PATENT DOCUMENTS

| | | | |
|---|---|---|---|
| H747 | 2/1990 | Jacobs et al. . | |
| 3,073,112 | 1/1963 | Bleikamp, Jr. et al. . | |
| 3,097,072 | 7/1963 | Lippman, Jr. et al. . | |
| 3,452,544 | 7/1969 | Glick et al. . | |
| 3,822,154 | 7/1974 | Lawrence et al. | 149/19.1 |
| 3,870,578 | 3/1975 | Nichols, Jr. | 149/19.4 |
| 3,972,846 | 8/1976 | Mori et al. | 260/30.4 N |
| 3,979,486 | 9/1976 | Herchin et al. | 264/3 B |
| 3,986,910 | 10/1976 | McCulloch et al. | 149/19.9 |
| 4,084,992 | 4/1978 | Hightower et al. | 149/17 |
| 4,098,626 | 7/1978 | Graham et al. | 149/19.4 |
| 4,099,376 | 7/1978 | Japs . | |
| 4,110,135 | 8/1978 | Graham et al. | 149/19.4 |
| 4,181,545 | 1/1980 | Anderson | 149/19.9 |
| 4,184,031 | 1/1980 | Graham et al. | 528/55 |
| 4,263,444 | 4/1981 | Graham et al. | 560/26 |
| 4,493,741 | 1/1985 | Ducote et al. | 149/19.4 |
| 4,498,292 | 2/1985 | White | 60/256 |
| 4,517,035 | 5/1985 | Duchesne et al. | 149/19.92 |
| 4,574,699 | 3/1986 | Bolieau | 102/202 |
| 4,597,924 | 7/1986 | Allen et al. | 264/3.6 |
| 4,655,858 | 4/1987 | Sayles | 149/19.92 |
| 4,655,860 | 4/1987 | Sayles | 149/19.92 |
| 4,658,587 | 4/1987 | Shaw | 60/205 |
| 4,798,636 | 1/1989 | Strecker | 149/19.9 |
| 4,913,753 | 4/1990 | Ducote | 149/19.9 |
| 4,924,405 | 5/1990 | Strosser et al. . | |
| 4,971,640 | 11/1990 | Chi | 149/19.9 |
| 5,579,634 | 12/1996 | Taylor | 60/219 |

FOREIGN PATENT DOCUMENTS

| | | |
|---|---|---|
| 93101181 | 1/1993 | European Pat. Off. . |
| 27 18 013 | 4/1977 | Germany . |

OTHER PUBLICATIONS

"Biplateau Burning Propellant Containing Aluminum", Carol J. Hinshaw and Vincent E. Mancini, Interim Report No. 3, Dec. 1993, prepared for Office of Naval Research.

(List continued on next page.)

*Primary Examiner*—Edward A. Miller
*Attorney, Agent, or Firm*—Cushman Darby & Cushman IP Group of Pillsbury Madison & Sutro, LLP; Ronald L. Lyons, Esq.

[57] ABSTRACT

Solid rocket motor propellants which burn at at least one stable burn rate over at least one corresponding pressure range (i.e the burn rate v. pressure curve contains at least one area of low pressure exponent with respect to a normal curve) are described. The propellant compositions comprise a binder, from about 65% to about 90% by weight ammonium perchlorate, the ammonium perchlorate being of at least two distinct particle sizes; from about 0.3% to about 5.0% by weight refractory oxide selected from the group consisting of $TiO_2$, $Al_2O_3$, $SiO_2$, $SnO_2$, and $ZrO_2$; and from about 5 to about 25% by weight metal, such as aluminum.

18 Claims, 1 Drawing Sheet

OTHER PUBLICATIONS

"Biplateau Burning Propellant Containing Aluminum", Dr. Carol J. Hinshaw and Vincent E. Mancini, Sep. 9, 1993, presented at Advanced Propellant Program Workshop, Chestertown, Maryland.

"Biplateau Burning Propellant Containing Aluminum", Carol J. Hinshaw and Vincent E. Mancini, Interim Report No. 2, Aug. 1993, prepared for Office of Naval Research.

"Development of Biplateau Burning Reduced Smoke and Aluminized AP Composite Propellants", J.O. Hightower, Dec. 17, 1992.

"Biplateau Burning Propellant Containing Aluminum", Carol Hinshaw and Vince Mancini, Program Scope Overview, Dec. 17, 1992.

"Initial Investigations of a Biplateau Burning Propellant Containing Aluminum Fuel", Feb. 12, 1992, proposal for Office of Naval Research.

"Development of Biplateau Burning Reduced Smoke and Aluminized AP Composite Propellants", J.O. Hightower, Feb. 4, 1992.

"Propellant Energy Management for Tactical Application", R.H. Taylor, Jr., Nov. 15, 1991, request for funding.

"A Proposal to SDIO for Biplateau Propellant Technology Development and Demonstration Program", Thiokol Corporation, Tactical Operations, Huntsville Division, Jul. 29, 1992.

ALUMINIZED PLATEAU-BURNING SOLID PROPELLANT FORMULATIONS AND METHODS FOR THEIR USE

Related Applications

This is a continuation of application Ser. No. 08/220,100, filed on Mar. 30, 1994, now abandoned which is a CIP of application Ser. No. 07/981.774, filed Nov. 25, 1992, now U.S. Pat. No. 5,334,270, which is a CIP of application Ser. No. 07/827,207 filed Jan. 29, 1992, now abandoned.

BACKGROUND

1. The Field of the Invention

The present invention is related to solid propellant compositions which are capable of burning at a selected, and relatively constant, burn rate over a relatively wide pressure range, including multiple burn rates and pressure ranges. More particularly, the present invention is related to metallized propellants which are formulated using one or more refractory oxides, such as $TiO_2$, $Al_2O_3$, $SiO_2$, $SnO_2$, and $ZrO_2$.

2. Technical Background

Solid propellants are used extensively in the aerospace industry. Solid propellants have developed as the preferred method of powering most missiles and rockets for military, commercial, and space applications. Solid rocket motor propellants have become widely accepted because of the fact that they are relatively simple to formulate and use, and they have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, ballistic catalysts, and other similar materials which aid in the processing and curing of the propellant. A significant body of technology has developed related solely to the processing and curing of solid propellants, and this technology is well known to those skilled in the art.

One type of propellant that is widely used incorporates ammonium perchlorate (AP) as the oxidizer. The ammonium perchlorate oxidizer may then, for example, be incorporated into a propellant which is bound together by a hydroxy-terminated polybutadiene (HTPB) binder. Such binders are widely used and commercially available. It has been found that such propellant compositions provide ease of manufacture, relative ease of handling, good performance characteristics; and are at the same time economical and reliable. In essence it can be said that ammonium perchlorate composite propellants have been the backbone of the solid propulsion industry for approximately the past 40years.

One of the problems encountered in the design of rocket motors is the control of the thrust output of the rocket motor. This is particularly true when it is desired to operate the motor in two or more different operational modes. For example, it is often necessary to provide a high level of thrust in order to "boost" the motor and its attached payload from a starting position, such as during launch of a rocket or missile. Once the launch phase has been completed, it may be desirable to provide a constant output from the rocket motor over an extended "sustain" operation. This may occur, for example, after the rocket has been placed in flight and while it is traveling to its intended destination.

In certain applications, it may be desired to provide more than one boost phase or more than one sustain phase. For example, it may be desired to boost the rocket motor into flight, then sustain flight at a particular speed and altitude, and then once again boost the rocket motor to a higher altitude or faster speed.

Until now, the performance of such multi-phased operations has been extremely difficult. It has been necessary to resort to complex mechanical arrangements in the rocket motors. Alternatively, less efficient and less desirable liquid rocket motors have been used to obtain multi-phase operation.

In some cases, multiple-phase operation has been attempted by constructing very complex propellant grains, such as grains having multiple propellants. In any case, achievement of multiple-phase operation has been complex, time consuming, and costly.

Accordingly, it would be an advancement in the art to provide propellant formulations which overcame the limitations of the art as set for above, and were capable of managed energy output. More particularly, it would be an advancement in the art to provide propellant formulations which were capable of operating at multiple stable burn rate outputs over a wide pressure region (referred to herein as "plateau propellants"). Specifically, it would be an advancement in the art to provide propellant formulations which were "biplateau" in nature. Alternatively, it would be an advancement in the art to provide propellants which were capable of operating at a more precise and predictably controlled single burn rate/pressure plateau. It would be a related advancement in the art to provide methods for tailoring the energy output of propellant formulations.

It would be a further advancement in the art to provide such propellant formulations in which the burn rate could be selected or quickly changed during operation between two pressure regions. Specifically, it would be a significant advancement in the art to provide such propellants which were capable of operating at more than one burn rate, depending on the pressure region under which the propellant is burning. In particular such operation would produce a constant burn rate within a range of pressure. The pressure could then be dropped or raised to a new range of pressures producing a second constant burn rate within the pressure region.

Such methods and compositions are disclosed and claimed herein.

BRIEF SUMMARY AND OBJECTS OF THE INVENTION

The present invention is related to metallized propellants which exhibit unconventional ballistic behavior. Specifically, the propellants of the present invention produce stable burn rates at at least one operating pressure region. That is, when burn rate is plotted against pressure, the slope of the resulting curve tends to level out or become negative at some predictable pressure region (i.e. produce a low or negative pressure exponent). The normal burning of solid propellant produces a burn rate v. pressure curve that is of a relatively constant positive slope over the range of expected operating pressures. Thus, the present invention provides propellants that produce a modified burn rate-pressure curve.

Exemplary burn rate v. pressure curves are illustrated in FIG. 1. FIG. 1 illustrates typical curves for propellant containing a high concentration of fine AP at 1, a high concentration of coarse AP at 2, and two modified curves produced when the present invention is employed at 3 and 4. Curve 3 is representative of propellants within the scope of the present invention which are cured with DDI. Curve 4 is representative of propellants within the scope of the present invention which are cured with IPDI.

The burn rate v. pressure curves for the propellants of the present invention are in contrast to such curves achieved using conventional propellants. For example, propellants containing high levels of fine AP usually have very steep burn rate/pressure curves, while propellants containing high levels of coarse AP usually have very flat burn rate/pressure curves. Conventional bimodal or trimodal AP composite propellants have constant pressure exponents from about 0.30 to about 0.60.

As will be appreciated from FIG. 1, the present invention provides unique burn rate v. pressure curves which include one or more plateaus separated by high pressure exponent regions. These plateaus facilitate achievement of specific operating parameters of the propellant.

For example, biplateau propellants fill a unique niche among the approaches to propellant energy management. The presence of the constant burn rate over a high-pressure range, and a second relatively constant burn rate over a low-pressure range provide an opportunity to design boost-sustain or sustain-boost motors utilizing only one propellant formulation. In addition, the insensitivity of burn rate to pressure in motor operation can have a positive effect on the motor design safety factors.

Propellants within the scope of the present invention include conventional binders such as HTPB binders, wide particle size distributions of ammonium perchlorate oxidizer, and a refractory oxide burn rate catalyst. The location of the plateau regions produced by these propellants has been found to be influenced by several controllable factors. These include the amount of plasticizer, the particle size and identity of the refractory oxide (such as titanium dioxide), the coarse/fine particle size distribution of the ammonium perchlorate, and the type of isocyanate curative used in the formulation. In addition, it has been observed that similar results can be obtained in both metallized formulations and non-metallized reduced smoke formulations.

Using the present invention it is possible to select the pressure range over which the propellant will have a plateau (low pressure exponent), or even a negative slope (negative pressure exponent) which is also known as "mesa" behavior. Significantly, it is possible to produce biplateau operation which results in plateaus at two pressure ranges separated by a region of higher slope. This phenomenon is illustrated in FIG. 1.

As mentioned above, the basic components of the propellants of the present invention include ammonium perchlorate having at least two distinct particle sizes, a refractory metal oxide, a binder, and a metal. The binder is preferably a conventional non-energetic binder such as a hydroxy-terminated polybutadiene (HTPB), polyether, polyester, or polybutadiene-acrylonitrile-acrylicacid terpolymer (PBAN). While energetic binders such as energetic oxetane binders, GAP, or PGN may be acceptable in some situations, they would generally be expected to mask the plateau effect.

Importantly, the ammonium perchlorate is of two distinct particle sizes. Generally, the ammonium perchlorate particles will be of sizes in the range of from about $2\mu$ to about $400\mu$. The smaller particles will generally be in the size range of from about $2\mu$ to about $5\mu$. The large or coarse ammonium perchlorate particles will generally be in the size range of from about $150\mu$ to about $400\mu$. The use of two or more distinct particle sizes is important in producing the desired plateau or biplateau effect.

The refractory metal oxide is important in catalyzing the desired plateau burning effect. A number of refractory metal oxides may be used in selected propellant formulations. Examples of such oxides include $TiO_2$, $Al_2O_3$, $SiO_2$, $SnO_2$, and $ZrO_2$. $TiO_2$ is particularly preferred in the formulations described herein. The refractory oxide is generally added such that it comprises from about 1.5% to about 2.0% by weight of the propellant. In addition, the size of the refractory oxide particles is generally in the range of from about $0.02\mu$ to about $0.8\mu$.

It is also observed that selection of a curative for incorporation into the propellant is of importance in producing the desired burn rate v. pressure curve. For example, various isocyanate curatives may be used with HTPB binders. Some of the presently preferred curatives include tetramethylxylylene diisocyanante (TMXDI), isophorone diisocyanate (IPDI), and dimeryl diisocyanate (DDI).

Different isocyanate curatives have been observed to produce different results. For example, TMXDI tends to produce a propellant which generates a high burn rate single plateau. IPDI tends to produce an intermediate burn rate single plateau, and DDI tends to produce a biplateau effect. Thus, selection of the appropriate curative for the desired effect is of importance.

In certain preferred embodiments of the invention, the propellant is "metallized." That is, the propellant includes from about 5% to about 25% by weight metal. The metal may be aluminum, magnesium or other suitable metal. In most of the applications described herein, aluminum is the metal of choice. The particle size of the metal is known to affect the plateau burning of the propellant. In most applications, metal particles in the range of $80\mu$ to $120\mu$ are presently preferred.

BRIEF DESCRIPTION OF THE DRAWINGS

In order that the manner in which the above-recited and other advantages and objects of the invention are obtained, a more particular description of the invention will be rendered by reference to the appended drawings. Understanding that these drawings depict only data related to typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

As described above, the present invention is related to a solid rocket motor propellant which burns at at least one stable burn rate over at least one corresponding pressure range (i.e the burn rate v. pressure curve contains at least one area of low pressure exponent with respect to a normal curve). The propellant compositions of the present invention comprise a binder, from about 65% to about 90% by weight ammonium perchlorate, said ammonium perchlorate being of at least two distinct particle sizes; from about 0.3% to about 5.0% by weight refractory oxide selected from the group consisting of $TiO_2$, $Al_2O_3$, $SiO_2SnO_2$, and $ZrO_2$; and from about 5 to about 25% by weight metal.

As mentioned above, the most widely used metal in the propellant formulations is likely to be aluminum. Aluminum will generally constitute from about 10% to about 22% by weight of the propellant compositions. The particle size of the metal is also important. Generally metallic particles will be in the range of from about 80$\mu$ to about 120$\mu$.

It is important that the ammonium perchlorate particles be of two or more widely distinct particle sizes. The small particles will have particle sizes in the range of from about 2$\mu$ to about 5$\mu$, while the larger particles will have particle sizes in the range of from about 150$\mu$ to about 400$\mu$. A more preferred size range for the large particles is from about 150$\mu$ to about 250$\mu$. In general, the ammonium perchlorate will comprise from about 50% to about 60% large particles, and from about 40% to about 50% small particles.

Figure 1:
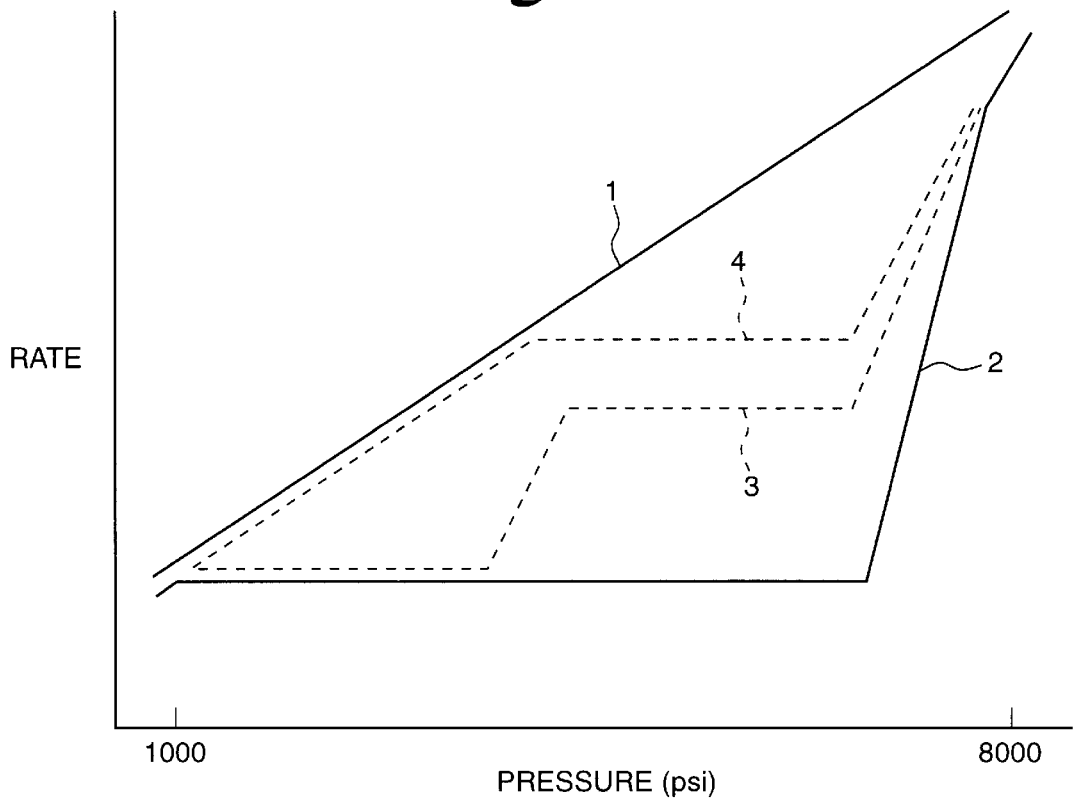
FIG. 1 is a graph of burn rate v. pressure illustrating hypothetical data for a high pressure exponent propellant, a low pressure exponent propellant, as well as the plateau burning of the present invention.

The general effect of varying the particle sizes of the ammonium perchlorate is illustrated in FIG. 1. FIG. 1 presents hypothetical data for illustrative purposes. It can be seen the'use of all fine ammonium perchlorate produces a straight line curve with a relatively high slope. The use of coarse ammonium perchlorate produces a straight line curve with a relatively low slope. Conversely, the use of two distinct (and widely different) particle sizes of ammonium perchlorate tends to produce a biplateau effect.

The presently preferred refractory metal oxide is $TiO_2$. The propellant will generally comprise from about 1.5% to about 2.0% refractory oxide. It is important that the refractory metal oxide particles fall within a specified range. The presently preferred size range is from about 0.02$\mu$ to about 0.8$\mu$.

As mentioned above, the curative used to cure the propellant formulation is also of critical importance. Generally, isocyanate curatives are used when HTPB binders are employed. Examples of such curatives include tetramethylxylylene diisocyanante (TMXDI), isophorone diisocyanate (IPDI), and dimeryl diisocyanate (DDI). Generally the curative comprises from about 0.5% to about 2.0% by weight of the propellant.

Other materials may also be added to the propellant formulations. For example, the propellant may comprise from about 1% to about 3% by weight plasticizer, such as dioctyladipate (DOA).

It is presently preferred that the binder be a conventional non-energetic binder such as a hydroxy-terminated polybutadiene. Other binders such as polyesters, polyethers, and PBAN also fall within the scope of the present invention. Such materials are readily available on the commercial market. For example one such binder is R45M hydroxy-terminated polybutadiene binder, manufactured by Atochem. The binder generally comprises from about 5% to about 10% by weight of the propellant formulation.

The present invention also relates to a method for tailoring the performance of a metallized solid rocket motor propellant such that the propellant exhibits a burn rate plateau over at least one pressure region. The basic steps in the method include incorporating within said propellant ammonium perchlorate having at least two distinct particle sizes, wherein a portion of the ammonium perchlorate particles have sizes in the range of from about 2$\mu$ to about 5$\mu$ and wherein another portion of the ammonium perchlorate particles have sizes in the range of from about 150$\mu$ to about 400$\mu$; incorporating within said propellant from about from about 0.3% to about 5.0% by weight refractory oxide selected from the group consisting of $TiO_2$, $Al_2O_3$, $SiO_2$, $SnO_2$, and $ZrO_2$; and selecting a binder for incorporation into the propellant, said binder generally comprising a hydroxy-terminated polybutadiene.

Exemplary formulations within the scope of the present invention have the following ingredients in approximately the following percentages:

R45M 5.00–410.00

Aluminum 5.00–25.00

Tepanol 0.05–0.15

DOA 1.00–3.00

$TiO_2$ 0.30–5.0

AP 65.00–90.00

ODI 0.01–0.08

TPB 0–0.02

DDI/IPDI 0.50–2.00

Among the abbreviations and tradenames used herein are:

R45M hydroxy-terminated polybutadiene (HTPB) binder, manufactured by Atochem

DOA dioctyladipate

ODI octadecylisocyanate

TPB triphenylbismuth

DDI dimeryl diisocyanate

IPDI isophorone diisocyanate

AP ammonium perchlorate

Tepanol HX878

MAO mixed antioxidant

Some of the effects of tailoring the ingredients placed within the propellant formulation include the ability to vary the burn level of the plateaus and to improve plateau definition. In particular, IPDI cure tends to result in one plateau at higher pressures. DDI cure tends to result in biplateau effect. By blending IPDI and DDI, it is possible to tailor the effects of the cure. At the same time, IPDI cure tends to vary burn rate level of the plateau. DDI cure varies burn rate level of the higher pressure plateau, but has a smaller effect on the lower plateau. By blending IPDI and DDI it is possible to tailor the burn rate level of the plateau(s).

In addition, it is observed that increasing the plasticizer level within the specific range tends to improve the plateau definition. Reduced ammonium perchlorate or additive levels tends to lower burn rates and decrease plateau definition. When fine ammonium perchlorate is increased, it is observed that plateau definition decreases. Increasing ammonium perchlorate level may also raise burn rates and decrease plateau definition.

Thus, it will be appreciated that by varying the parameters outlined above, it is possible to achieve the specific plateau behavior desired. By selecting ingredients within the specified ranges of particle size and weight percent of the propellant formulation, it is possible to achieve plateau or biplateau performance, and to vary the pressures and burn rates at which those plateaus occur.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

Thermogravimetric analyses were conducted on HTPB gumstocks with either IPDI or DDI curatives and with and without DOA plasticizer in an effort to simulate what happens at the melt layer surface during combustion. Experimental runs at a heating rate of 20° C./min. were run under air and nitrogen atmospheres. The composition of the gumstocks were as follows:

| | Weight Percent of Composition | | | |
|---|---|---|---|---|
| R45M | 81.80 | 91.46 | 68.17 | 76.78 |
| DDI | 18.20 | — | 15.17 | — |
| IPDI | — | 8.54 | — | 6.56 |
| DOA | — | — | 16.66 | 16.66 |

The non-plasticized IPDI-cured gumstock began a gradual weight loss approximately 30° C. earlier than the non-plasticized DDI-cured gumstock. The DDI-cured gumstock lost approximately five percent weight and the IPDI-cured gumstock lost approximately seven percent weight prior to the major weight loss or binder decomposition. Both samples containing plasticizer began weight loss at 144° C. and lost approximately 15 weight percent.

These data support the suggestion that the cured binder cleaves at the urethane linkage in the first major step of the decomposition sequence, followed by curative volatilization. IPDI is more volatile than is DDI and once the urethane bond is broken, IPDI vaporizes faster than DDI. In those samples containing plasticizer, the DOA which is not chemically cross-linked, is the first component to volatilize with the remaining sequence the same as the non-plasticized binders.

Example 2

Laser pyrolysis tests were conducted with the gumstocks described in Example 1 as well as with $TiO_2$ filled gumstocks. Weight loss measurements were obtained at 50 and 190 cal/cm$^2$-sec and surface temperature measurements taken with an infrared video camera. Smoke clouds were observed during the pyrolysis of the unfilled gumstocks and visual examination of the pyrolyzed surface showed deep craters were formed. The laser pyrolysis samples filled with the $TiO_2$ were quite different in appearance. The samples filled with coarse $TiO_2$ formed a red ash on the surface during pyrolysis which collected to a black char layer on the surface of a crater. The samples filled with fine $TiO_2$ produced white sparks and spalled during testing, and cooled to a black char layer on the surface of a crater. It appeared that the binder containing the fine particles of $TiO_2$ lost less weight than did the binder containing the coarse particles of $TiO_2$.

Example 3

A 10% aluminum formulation was tested. The formulation contained the following ingredients expressed in weight percent:

| Material | Nominal Weight % |
|---|---|
| R45M | 8.205 |
| DDI | 1.660 |
| Tepanol | 0.075 |
| DOA | 2.00 |
| TPB | 0.020 |
| AP (200$\mu$) | 44.080 |
| AP (2$\mu$) | 31.920 |
| Aluminum | 10.00 |
| $TiO_2$ | 2.00 |
| ODI | 0.040 |

The propellant was mixed having an isocyanate ratio of 0.89. Brookfield end-of-mix viscosity was 3 Kp at 135° F., with potlife to 40 Kp extrapolated to 7.5 hours.

Figure 2:
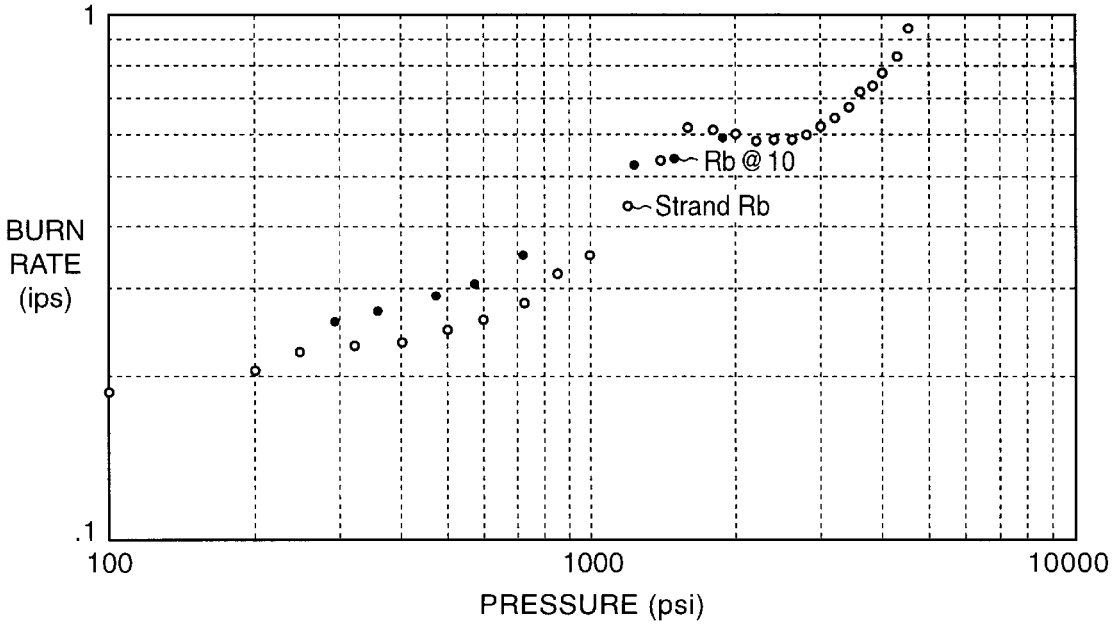
FIG. 2 is a graph presenting actual data illustrating the biplateau effect for one propellant formulation within the scope of the present invention.

Strand and TU-172 motor (2-inch diameter, 3.4 inch length center perforate (CP) grain) data are presented in FIG. 2. A low pressure plateau extends from 250 psi to 725 psi, having a pressure exponent of 0.22. The burn rate at 400 psi was 0.23 inches per second (ips). The high-pressure plateau extends from 1600 to 2600 psi with a pressure exponent of −0.11. The burn rate at 2200 psi was 0.59 ips.

Example 4

A 15% aluminum biplateau propellant was made and characterized. The propellant comprised 15% aluminum, 1.5% DOA, an ammonium perchlorate coarse/fine (200$\mu$:2$\mu$) ratio of 55:45, DDI NCO/OH of 0.89, with 2% $TiO_2$.

Upon burning, the plateau regions were well defined. The low-pressure plateau occurred across a pressure range of 300 psi to 500 psi and had an exponent of 0.24. The high pressure plateau occurred across a pressure range of 1800 psi to 2300 psi and had a pressure exponent of −0.22. The burn rate at 400 psi was 0.27 ips and the burn rate at 2000 psi was 0.59 ips.

Examples 5–7

Three propellants were prepared and characterized according to the teachings of the present invention. Effect of DOA and coarse to fine AP particle size was observed. The compositions tested were as follows (given as weight percent of the propellant formulation):

| Material | Mix 1 | Mix 2 | Mix 3 |
|---|---|---|---|
| R45M | 8.219 | 8.636 | 8.219 |
| Tepanol | 0.075 | 0.075 | 0.075 |
| DOA | 2.000 | 1.500 | 2.000 |
| AP (200$\mu$) | 39.760 | 39.760 | 39.050 |
| AP (2$\mu$) | 31.240 | 31.240 | 31.950 |
| ODI | 0.040 | 0.040 | 0.040 |
| $TiO_2$ | 2.000 | 2.000 | 2.000 |
| Al | 15.000 | 15.000 | 15.000 |
| DDI | 1.646 | 1.729 | 1.646 |
| TPB | 0.020 | 0.020 | 0.020 |

The propellant formulations were tested and burn rate v. pressure was measured. The results were as follows:

| Mix # | Pressure range (psi) | Burn rate (ips) | Pressure Exponent |
|---|---|---|---|
| 1 | 250–455 | 0.22–0.24 | 0.14 |
| 1 | 1625–2425 | 0.54–0.56 | 0.10 |

-continued

| Mix # | Pressure range (psi) | Burn rate (ips) | Pressure Exponent |
|---|---|---|---|
| 2 | 250–460 | 0.22–0.25 | 0.19 |
| 2 | 1810–2315 | 0.59–0.56 | −0.18 |
| 3 | 250–460 | 0.23–0.25 | 0.14 |
| 3 | 1710–2310 | 0.64–0.57 | −0.42 |

Each of the propellant formulations exhibited biplateau behavior.

Summary

The present invention provides propellant formulations which are capable of operating in a plateau, or biplateau manner. That is, the propellant is capable of operating at one or more substantially stable burn rates. The burn rate can be selected or changed during operation and the propellant is capable of operating at more than one burn rate, depending on the pressure under which the propellant is burning. In this manner it is possible to control the operation of a solid propellant rocket motor.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for tailoring the performance of a metallized solid rocket motor propellant such that the propellant exhibits at least two stable burn rates over at least two corresponding pressure ranges comprising the steps of:

incorporating within said propellant a biplateau burning amount of ammonium perchlorate having at least two distinct particle sizes, wherein a portion of the ammonium perchlorate particles have sizes in the range of from about 2$\mu$ to about 5$\mu$ and wherein another portion of the ammonium perchlorate particles have sizes in the range of from about 150$\mu$ to about 400$\mu$;

incorporating within said propellant a biplateau burning amount of a refractory oxide selected from the group consisting of $TiO_2$, $Al_2O_3$, $SiO_2$, $SnO_2$, and $ZrO_2$; and selecting a binder for incorporation into the propellant incorporating within said propellant at least one binder, such that a metallized solid rocket motor propellant is formed;

igniting said solid rocket motor propellant such that the propellant formulation burns at at least two stable burn rates over at least two corresponding pressure ranges such that the propellant provides boost-sustain operation when burned in a solid rocket motor.

2. A method for tailoring the performance of a metallized solid rocket motor propellant as defined in claim 1 wherein said binder comprises a hydroxy-terminated polybutadiene.

3. A method for tailoring the performance of a metallized solid rocket motor propellant as defined in claim 2 further comprising the step of adding a curative to the propellant for curing the propellant.

4. A method for tailoring the performance of a metallized solid rocket motor propellant as defined in claim 3 wherein said curative is selected from the group consisting of tetramethylxylylene diisocyanate (TMXDI), isophorone diisocyanate (IPDI), and dimeryl diisocyanate (DDI).

5. A method for tailoring the performance of a metallized solid rocket motor propellant as defined in claim 1 wherein said large ammonium perchlorate particles have particle sizes in the range of from about 150$\mu$ to about 250$\mu$.

6. A method for tailoring the performance of a metallized solid rocket motor propellant as defined in claim 1 further comprising the step of adding a plasticizer to the propellant.

7. A method for tailoring the performance of a metallized solid rocket motor propellant as defined in claim 6 comprising the step of adding from about 1.0% to about 2.0% plasticizer to the propellant.

8. A method for tailoring the performance of a metallized solid rocket motor propellant as defined in claim 6 wherein said plasticizer is dioctyladipate.

9. A method for formulating and burning a metallized solid rocket motor propellant which burns at at least two stable burn rates over at least two corresponding pressure ranges, the method comprising the step of formulating a solid rocket motor propellant comprising:

a binder comprising a hydroxy-terminated polybutadiene;

from about 65% to about 90% by weight ammonium perchlorate, said ammonium perchlorate comprising particles having at least two distinct particle sizes;

a biplateau burning amount of a refractory oxide selected from the group consisting of $TiO_2$, $Al_2O_3$, $SiO_2$, and $ZrO_2$; and from about 5% to about 25% by weight metal;

igniting said solid rocket motor propellant such that the propellant formulation burns at at least two stable burn rates over at least two corresponding pressure ranges such that the propellant provides boost-sustain operation when burned in a solid rocket motor.

10. A method for formulating a metallized solid rocket motor propellant as defined in claim 9 wherein the particle size of the refractory oxide is in the range of from about 0.02$\mu$ to about 0.4$\mu$.

11. A method for formulating a metallized solid rocket motor propellant as defined in claim 9 wherein the propellant further comprises a cure agent.

12. A method for formulating a metallized solid rocket motor propellant as defined in claim 11 wherein the cure agent is selected from the group consisting of isophorone diisocyanate and dimeryl diisocyanate.

13. A method for formulating a metallized solid rocket motor propellant as defined in claim 8 wherein said ammonium perchlorate comprises small particles and larger particles, and wherein the size of the small particles is in the range of from about 2$\mu$ to about 5$\mu$.

14. A method for formulating a metallized solid rocket motor propellant as defined in claim 13 wherein said large ammonium perchlorate particles have particle sizes in the range of from about 150$\mu$ to about 400$\mu$.

15. A method for formulating a metallized solid rocket motor propellant as defined in claim 9 wherein the refractory oxide is $TiO_2$.

16. A method for formulating a metallized solid rocket motor propellant as defined in claim 9 wherein the propellant comprises about 1.0% to about 2.0% refractory oxide.

17. A method for formulating a metallized solid rocket motor propellant as defined in claim 9 wherein the propellant comprises from about 6.0% to about 10.0% hydroxy-terminated polybutadiene binder.

18. A method for tailoring the performance of a metallized solid rocket motor propellant such that the propellant is capable of exhibiting at least two stable burn rates over at least two corresponding pressure ranges consisting essentially of:

incorporating within said propellant a biplateau burning amount of ammonium perchlorate having at least two distinct particle sizes, wherein a portion of the ammonium perchlorate particles have sizes in the range of from about 2$\mu$ to about 5$\mu$ and wherein another portion of the ammonium perchlorate particles have sizes in the range of from about 150$\mu$ to about 400$\mu$;

incorporating within said propellant a biplateau burning amount of a refractory oxide selected from the group consisting of $TiO_2$, $Al_2O_3$, $SiO_2$, $SnO_2$, and $ZrO_2$; and selecting a binder for incorporation into the propellant incorporating within said propellant at least one binder, such that a metallized solid rocket motor propellant is formed;

igniting said solid rocket motor propellant such that upon burning the propellant formulation exhibits at least two stable burn rates over at least two corresponding pressure ranges such that the propellant provides boost-sustain operation when burned in a solid rocket motor.

* * * * *